United States Patent [19]

Bauerle

[11] 4,007,977

[45] Feb. 15, 1977

[54] ELECTRICAL CONNECTOR

[75] Inventor: Gerhard Bauerle, Willsbach, Germany

[73] Assignee: Bunker Ramo Corporation, Oak Brook, Ill.

[22] Filed: May 9, 1974

[21] Appl. No.: 468,394

[52] U.S. Cl. ..... 339/217 S

[51] Int. Cl.[2] ..... H01R 13/40

[58] Field of Search ..... 339/217 R, 217 S, 258 R, 339/258 C, 258 F, 258 P, 259 R, 206 R, 206 P, 207 R, 209, 210 R, 210 M, 220, 221, 176 R, 176 M

[56] References Cited

UNITED STATES PATENTS

| | | | |
|---|---|---|---|
| 2,779,011 | 1/1957 | Deakin | 29/629 X |
| 3,047,831 | 7/1962 | Majewski | 339/217 S X |
| 3,165,369 | 1/1965 | Maston | 339/210 M |
| 3,311,867 | 3/1967 | Beauchaine | 339/217 S |
| 3,685,001 | 8/1972 | Krafthefer | 339/217 S X |
| 3,732,529 | 5/1973 | Weisenburger | 339/210 M X |
| 3,865,462 | 2/1975 | Cobaugh et al. | 339/176 M |

*Primary Examiner*—Joseph H. McGlynn
*Attorney, Agent, or Firm*—F. M. Arbuckle

[57] ABSTRACT

An electric connector comprising a dielectric housing with front and rear surfaces and a plurality of cavities extending longitudinally between the surfaces, each cavity having a pair of oppositely oriented guide ledges frontwardly disposed in the cavity and laterally extending inwardly from diagonally opposite side portions of the cavity, and a plurality of electrical contacts mounted in the housing, each contact including a pair of opposed spring arms with frontwardly disposed, inwardly bowed engagement portions for receiving a mating contact and a rearwardly disposed tail portion for receiving a conductive element, the engagement portions further including a pair of laterally offset tabs arranged for abutting engagement with the ledges to individually position and limit inward movement of each engagement portion without restricting outward movement of the engagement portion. In one embodiment, the guide ledges extend rearwardly to rear cam surfaces outwardly inclined to engage the tabs and guide the spring arms during insertion from the rear into each cavity. The embodiment also includes a rear base for supporting an upper body portion with the cavities and with rectangular openings through which the contact tail portions extend and are restricted in rotation.

2 Claims, 7 Drawing Figures

ELECTRICAL CONNECTOR

BACKGROUND

This invention relates to electric connectors housing contacts having a plurality of spring members and more particularly to connectors housing contacts with opposed spring members.

The loading or assembly of electrical connectors housing a plurality of contacts with opposed spring members or arms for frontwardly receiving mating contacts has been associated with a number of problems. In one type of these connectors, the spring members are centrally located and separated by small ribs molded in a pair of opposite sides of the contact-receiving cavities. During assembly, the spring members ride on closely spaced, outwardly facing shoulders of the ribs and are maintained in a spaced apart relationship by the ribs. With miniaturized connectors, the ribs can be very narrow which can cause complications in dimensional accuracy in the location of the ribs and each of the shoulders. Extreme narrowness of the ribs can in some instances also cause damage to the ribs during assembly of the contacts or during insertion of mating contacts. In addition, the rib necessitate separation of the spring arms which is not always desirable.

SUMMARY

The invention relates to electrical connectors housing one or more metallic contacts with opposed spring arms for frontwardly receiving mating contacts. Briefly, the connector includes a dielectric housing including a front surface and at least one cavity opening on the surface and rearwardly extending longitudinally in the housing, and contact positioning means in the cavity including a pair of laterally separated surfaces. The connector further includes contact means mounted in the housing and frontwardly including a pair of opposed spring arms at least partially disposed in the cavity for engagement with a mating contact and including inwardly facing opposed engagement portions arranged for outward movement apart and reverse inward movement during respective engagement and disengagement by the mating contact, and limiting means including a pair of laterally offset, inwardly facing surfaces on the engagement portions with each of the surfaces being arranged for cooperating with the contact positioning means for limiting inward movement of one of the engagement portions while permitting inward movement of the other of the engagement portions.

In one preferred embodiment, the connector includes a dielectric housing with one or more cavities shaped with a pair of guide ledges as contact positioning means inwardly disposed from diagonally opposite portions of the cavity sides and with each of the ledges having an inwardly facing shoulder. One or more metallic contacts are mounted in the housing with each contact frontwardly including a pair of opposed, inwardly facing spring arms at least partially disposed in one of the cavities with the spring arms including a pair of laterally offset, limiting tabs as limiting means having inwardly oriented surfaces. Each of the tabs extends laterally from one of the spring arms beyond the adjoining spring arm so that each guide ledge positions only one of the spring arms. The invention further includes rear portions of the guide ledges which include outwardly inclined cam surfaces to direct the spring arms into the desired forward position when inserted into the rear of the cavity. Rearwardly disposed in each cavity is a stop surface to limit forward movement of the contact in the cavity. In the preferred embodiment, rectangular openings are provided in the lower portion of the housing to restrict rotation of the tail portions which may be subject to rotational forces during wire wrapping.

One of the advantages of the invention is that each ledge can be of significant size to avoid damage during the loading of the contacts and by mating contacts. A second advantage is that each ledge and tab act in combination to limit inward movement of one spring arm without restricting inward movement of the other spring arm. Another advantage is that the shoulders for abutting engagement with the laterally extending tabs can be located to permit the spring arms to be closely positioned or separated by predetermined distances. Yet another advantage is that the ledges can be so located to resist twisting torques by wire wrapping or other forces on the contacts. Still another advantage is that the guide ledges and tabs on the contacts effectively guide the contacts into the desired position. An additional advantage particularly when the front openings in the housing have protective surrounding ridges is that rear stop surfaces can be provided thereby avoiding dependency of the spring arms on the front ridges as front stops which can restrict the desired movement of the spring arms during mating and unmating engagement.

DETAILED DESCRIPTION

Figure 1:
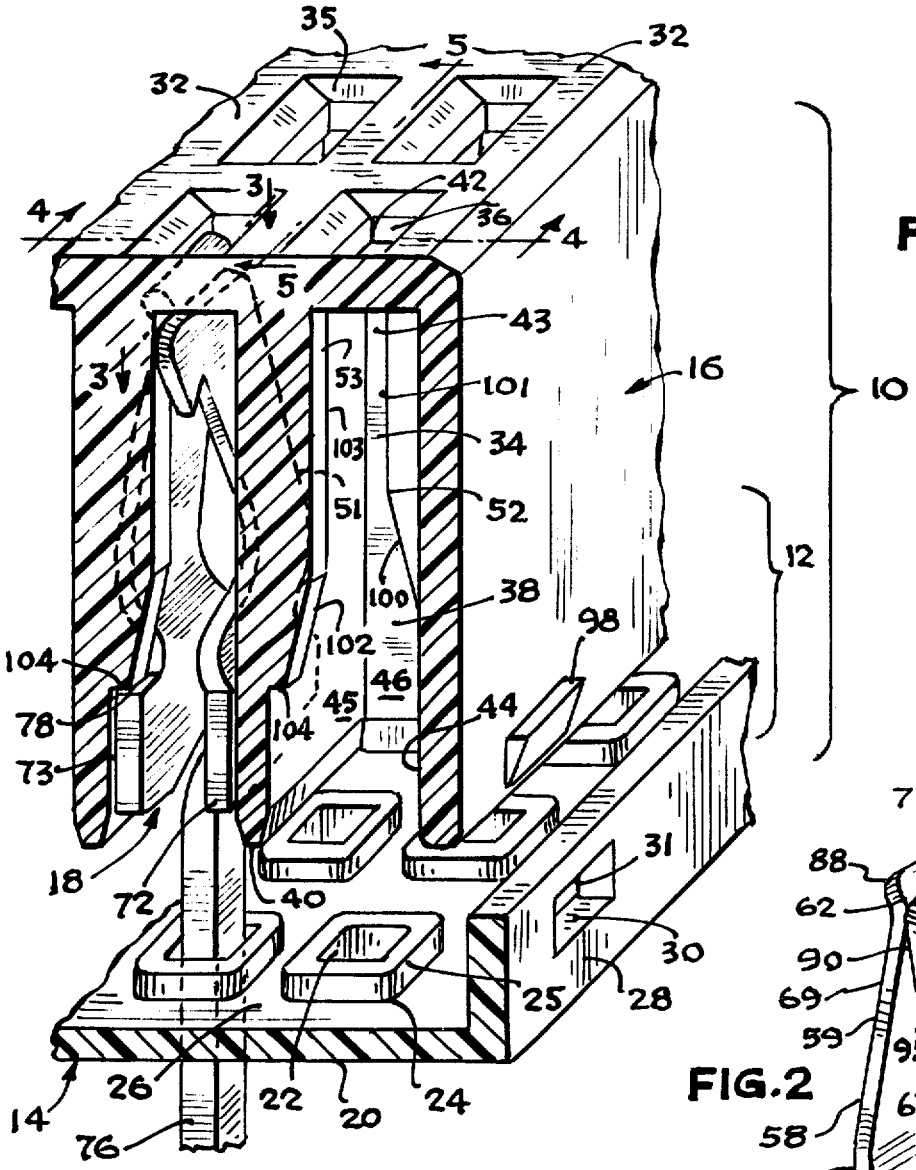
FIG. 1 is a perspective view of a section of an electrical connector representing one embodiment of the invention.
Figure 2:
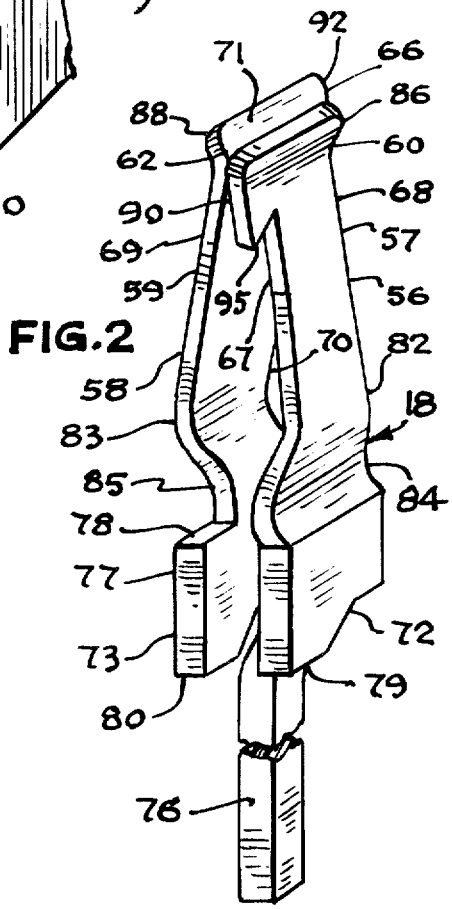
FIG. 2 is a perspective view of an electrical contact further representing the invention.
Figure 3:
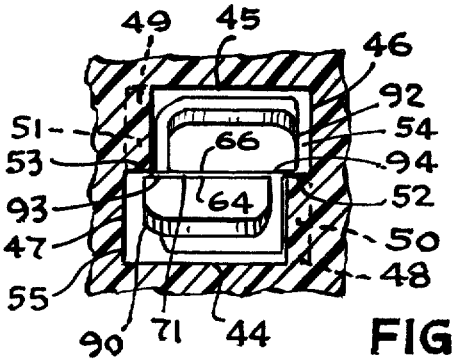
FIG. 3 is a top view of a section of the electrical connector of FIG. 1 taken along line 3—3.
Figure 4:
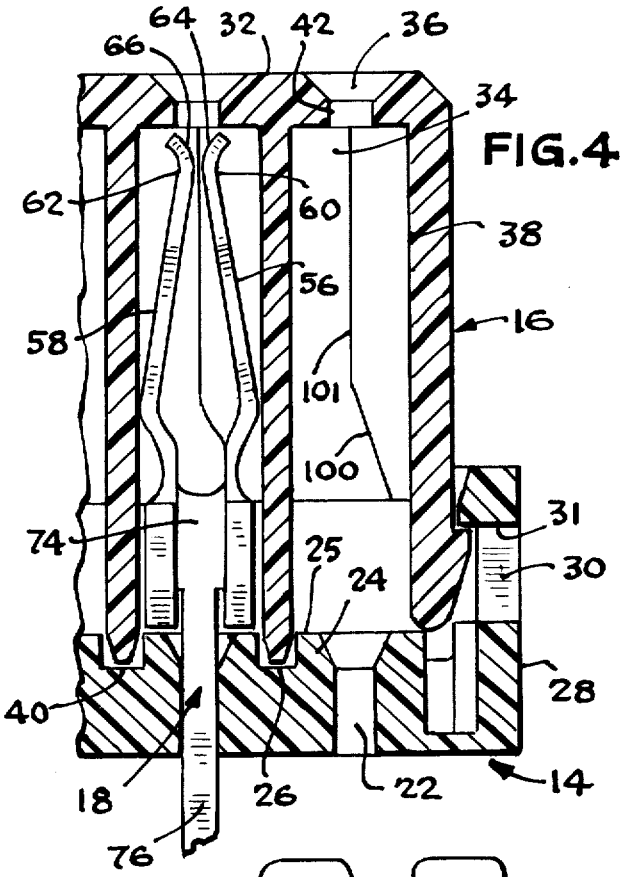
FIG. 4 is a side view in section taken along line 4—4 of FIG. 1.

Referring now in detail to FIGS. 1 – 5, reference 10 represents an electrical connector including a dielectric housing 12 comprising lower base 14 and upper body 16 supported by the base, and a plurality of metallic contacts 18 at least partially disposed in the housing. As illustrated in FIG. 1, base 14 includes a generally flat portion 20 provided with a plurality of rectangular openings 22 and raised collars 24 encompassing the openings and forming grooves 26. As illustrated in FIG. 4, collars 24 structurally strengthen the base around openings 22 and include upper surfaces 25 serving as a rear stop for each of the contacts 18. Grooves 26 provide alignment of body 16 during assembly of the housing. Base 14 further includes side member 28 laterally spaced apart from openings 22 and upwardly extending from flat portion 20. Latch opening 30 with one or more surfaces 31 are provided on side member 28 to provide latching engagement between base 14 and body 16.

Figure 5:
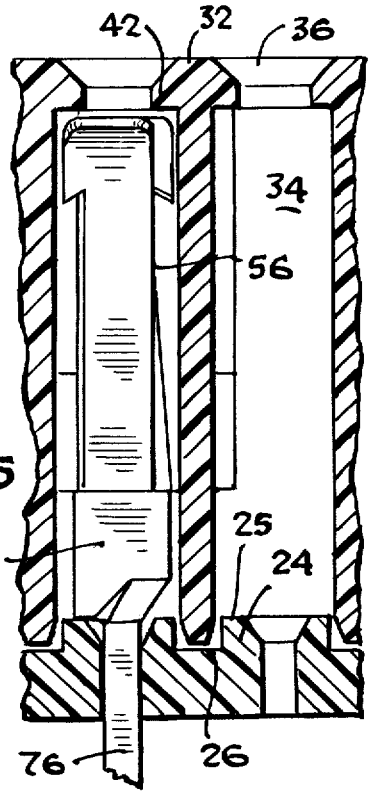
FIG. 5 is a side view in section of FIG. 1 taken along line 5—5.

Body 16 is provided with front face or surface 32 and a plurality of cavities 34 in rows 35 with front openings 36 on front surface 32 for entry of mating contacts and rearwardly extending longitudinally into the body. As illustrated in FIGS. 1 and 4 - 5, cavities 34 extend rearwardly through body 16 and are separated by longitudinally extending wall portions 38 having rear tapered edges 40 shaped to fit in grooves 26 of base 14. Front surface 32 also includes tapered ridges 42 restricting the size of openings 36 and protecting contacts 18 from oversized mating contacts. Rearwardly disposed from openings 36 in cavities 34 are enlarged box-like sections 43, each including opposite longitudinal sides 44–45 and 46–47. As illustrated in FIG. 3, sides 44 – 45 include diagonally opposite portions 48 – 49 which are provided with guide ledges 50 – 51. In the preferred embodiment, guide ledges 50 – 51 extend from opposed portions 48 – 49 inwardly into the cavity 34 and form limiting shoulders or means 52 – 53 each of which has an inwardly facing laterally separated surface or offset in opposite lateral directions. Shoulders 52 – 53 are disposed apart from side 44 and laterally separated in a direction parallel to side 44. Each guide ledge is separated from the opposite wall to form recesses 54 – 55 which permit outward flexing of contact 18.

As illustrated in FIGS. 1 – 5, contact 18 is formed with a pair of opposing or opposed spring arms 56 and 58 having upper bows 60 and 62 with generally broad engagement portions or faces 64 and 66 inwardly directed and adjacent sides 67 – 68 abd 69 – 70 forming a central portion 71 of the spring arms for receiving a mating contact. The lower ends 72 – 73 are laterally spaced apart and integrally joined by the offset leg of U-shaped bridge portion 74 from which tail portion 76 extends rearwardly for connection to a conductive element by wire wrapping or other technique. As illustrated in FIGS. 1 and 3 – 5, lower ends 72 – 73 include at lest one laterally projecting flange 77 with frontwardly facing shoulder 78 to provide a front stop in the positioning of contact 18 in cavity 34. Rear stops are provided by shoulders 79 and 80 positioned against upper surfaces 25 of collars 24. Frontwardly extending from lower ends 72 – 73 are engagement portions 57 and 59 with upper inwardly oriented bows 60 and 62 which rearwardly extend to lower outwardly oriented bows 82 – 83 integrally connected to lower ends 72 – 73 through lower inwardly oriented bows 84 – 85. Bows 82 – 95 enable spring arms 56 and 58 to flex both laterally and longitudinally. Contact 18 is further provided with upper free ends 86 and 88 rearwardly separated in cavity 34 from upper ridges 42 around opening 36 and arranged for movement inwardly and outwardly without restriction by ridges 42.

Engagement portions 64 and 66 adjacent the front surface of the dielectric housing move in a common plane and further include a pair of laterally offset tabs 90 and 92 having inwardly directing surfaces or inwardly facing surfaces 93-94 offset in opposite lateral direction with tabs 90 and 92 to form limiting means for abutment against shoulders 52 – 53 in cavity 34 which are located adjacent the longitudinal mid-plane between engagement portions. As illustrated, tab 90 extends from adjacent side 67 laterally beyond side 69 of opposed engagement portion 59, while tab 92 extends from adjacent side 70 laterally beyond side 68. In FIG. 3, the positioning of tabs 90 and 92 are illustrated as well as central portion 71 formed by closely spaced faces 64 and 66. Representative guide ledge 50 extends inwardly past spring arm 56 to surface 94 of arm 58 limiting inward movement of arm 58 without limiting inward movement of arm 56. Shoulders 52 – 53 of body 16 are arranged adjacent sides 67 – 70 for engagement with tabs 90 and 92. Recesses 54 and 55 permit outward flexing of each spring arm while ledges 50 and 51 are of sufficient size to resist the usual forces developed during the loading of the contacts and insertion of mating contacts. Lower hook like portion 95 is provided on tab 90 as an aid in automatic loading of the contacts into the cavities.

In the assembly of contacts 18 into housing 12, the contacts can be mounted by alternative techniques. Tail portions 76 can be initially inserted in the openings 22 with rear shoulders 79 – 80 resting against collars 24 after which body 16 is downwardly inserted over the contacts and latched to base 14 by a side latch 98 which snaps into opening 30. During downward movement of body 16, tabs 90 and 92 are centrally positioned in cavity 34 to predetermined positions against shoulders 52 – 53 by rear cam surfaces 100 and 102 and guides 101 and 103. Downward movement of body 16 continues until the latching engagement between the body and the base and until rear stop shoulder 104 moves next to or against front shoulder 78 of the contact. An alternative loading technique can be carried out by inserting spring arms 56 and 58 of each contact frontwardly in the cavity 34 with cam surfaces 100 and 102 and guides 101 and 103 serving to center tabs 90 and 92 and spring arms 56 and 58 in the cavity. Front stop 78 and shoulder 104 limit forward positioning of contact 18 in the cavity. Base 14 is then rearwardly snapped or latched to body 16 with tail portions 76 rearwardly extending through openings 22.

Figure 6:
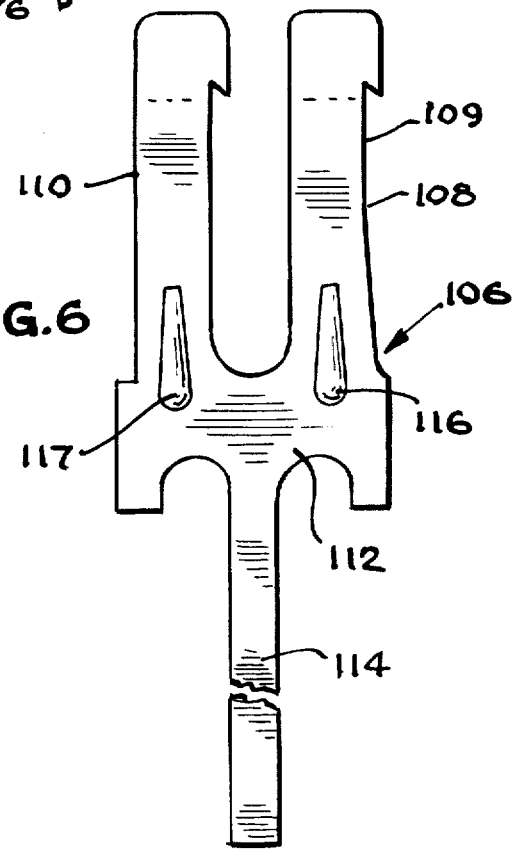
FIG. 6 is a sheet metal blank which can be folded to form an electrical contact incorporating further features of the invention.
Figure 7:
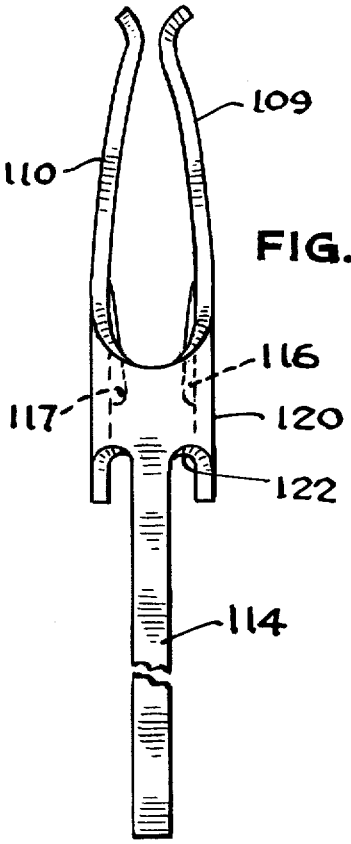
FIG. 7 is a side view of the contact formed from the sheet metal blank of FIG. 6.

In another embodiment of the contact of the invention, FIG. 6 represents a sheet metal blank from which the electrical contact of FIG. 7 can be formed. As illustrated, the sheet metal blank 106 frontwardly includes a U-shaped portion 108 with arms 109 – 110 and bridge portion 112. Bridge portion 112 integrally joins arms 109 – 110 and is rearwardly integrally joined to tail 114. Reinforcing members 116–117 are formed in arms 109 – 110 to stiffen the lower portion of the arms. The contact 120 in FIG. 7 is formed with blank 106 by folding arms 109 – 110 in a common lateral direction to form with bridge 112 a channel portion 122 and position arms 109 – 110 in opposing relationship. Thus the bridge member 112 has spaced apart facing flanges for abutment with the walls of the cavity, to limit rotation of the contact and the engagement portions extend frontwardly therefrom. Contacts 120 can be loaded in a housing 12 or similar housing in a similar manner to contacts 18 and provide similar advantages in the resultant assembly.

Following assembly of connector 10, tail portions 76 can be wire wrapped or connected to a conductive element by similar technique. With wire wrapping, the rectangular openings 22 rearwardly in housing 12 and collars 24 in engaging relationship with tail portions 76 provide contact restriction means for restricting rotation of the rigid post-like tail portions 76. During mating and unmating engagement with a mating contact, shoulders 52 – 53 and tabs 90 and 92 limit inward movement of spring arms 56 and 58 and engagement portions 57 and 58 while permitting movement outwardly away from shoulders 52 – 53

As exemplary materials of construction for connector 10, housing 12 is molded of a dielectric material such as polycarbonate. Contacts 18 are composed of phosphor bronze and stamped from sheet metal material having a dual thickness portion for tail portion 76.

I claim:

1. An electrical connector comprising:

a dielectric housing including a base having an opening encircled by a raised collar and a body member having a front surface and at least one cavity open on said surface and rearwardly extending longitudinally therefrom in communication with the opening in said base defined by a box-like wall section with longitudinal sides in encircling engagement with said collar and a pair of limiting shoulders disposed apart from said sides and laterally separated parallel to said sides, and at least one metallic contact, said contact being mounted in said housing and frontwardly including a pair of opposite, inwardly-facing spring arms for receiving a mating contact and rearwardly including spaced facing flanges abutting said collar and engaging said sides and a tail portion passing through the opening in said base for receiving a conductive element, said spring arms frontwardly including a pair of engagement portion means at least partially disposed in said box-like section and movable in a commmon plane with one of said portions facing said side and inwardly facing said other portion, said engagement portion means including a pair of laterally offset tabs in inwardly limiting engagement with said shoulders, said shoulders located adjacent the longitudinal mid-plane between said engagement portions, each of said engagement portion means having one of said tabs extending laterally beyond the other portion to one of said shoulders and being outwardly movable away therefrom.

2. An electrical connector comprising:

a dielectric housing including a generally flat base with a plurality of rectangular openings, raised collars encompassing said openings and grooves separating adjacent collars, and a frontwardly extending side member laterally spaced apart from said openings, and a body member including front and rear surfaces and mounted on the base, a plurality of cavities extending between the surfaces with front restricted openings, the body member having walls longitudinally surrounding the cavities with rear edges on said walls shaped to fit into grooves when the body member is mounted on the base, a plurality of electrical contacts mounted in said housing, each of said contacts including a pair of opposed spring arm means at least partially disposed in a respective one of said cavities for movement in a common plane and a tail portion rearwardly extending through a respective one of said rectangular openings for connection to a conductive element and rotationally restricted by the respective rectangular opening, the opposed pair of spring arm means including lower ends spaced apart laterally in abutment with a respective collar and engagement portions upwardly extending therefrom, said engagement portions being bent outwardly and then inwardly to form lower outwardly oriented bows each abutting a respective one of said walls for restricting rotation of said contacts and upper inwardly oriented bows and including a tab for each opposed spring arm means with each tab on the opposed pair of spring arm means offset in an opposite lateral direction.

said body member including a pair of limiting shoulders for each cavity disposed apart from a respective one of said walls and laterally separated parallel to the respective wall, each tab engaging a respective one of said shoulders thereby limiting inward movement of the respective engagement portion toward the other engagement portion.

* * * * *